US009845969B2

(12) United States Patent
Ali

(10) Patent No.: US 9,845,969 B2
(45) Date of Patent: Dec. 19, 2017

(54) GRAVITY SHUTTER

(71) Applicant: Petra Engineering Industries Co., Amman (JO)

(72) Inventor: Osama Mohammad Hussein Ali, Amman (JO)

(73) Assignee: Petra Engineering Industries Co., Amman (JO)

( * ) Notice: Subject to any disclaimer, the term of this patent is extended or adjusted under 35 U.S.C. 154(b) by 872 days.

(21) Appl. No.: 13/778,832

(22) Filed: Feb. 27, 2013

(65) Prior Publication Data

US 2014/0242902 A1 Aug. 28, 2014

(51) Int. Cl.

| | |
|---|---|
| ***F24F 13/10*** | (2006.01) |
| ***F24F 13/14*** | (2006.01) |
| ***F24F 1/00*** | (2011.01) |
| ***F24F 13/04*** | (2006.01) |

(52) U.S. Cl.

CPC ..... *F24F 13/10* (2013.01); *F24F 1/00* (2013.01); *F24F 13/04* (2013.01); *F24F 13/14* (2013.01)

(58) Field of Classification Search

CPC ..... F24F 13/10
USPC ..... 454/359
See application file for complete search history.

(56) References Cited

U.S. PATENT DOCUMENTS 3,334,569 A * 8/1967 Lambie ..... 454/352
3,451,165 A * 6/1969 O'Hair ..... 49/87.1
3,479,947 A * 11/1969 Myers ..... 454/344
3,822,637 A * 7/1974 Whitlock ..... 454/20
4,059,903 A * 11/1977 Piet et al. ..... 312/1
4,371,386 A * 2/1983 DeVecchi ..... 55/338
4,375,183 A * 3/1983 Lynch ..... 454/292
(Continued)

FOREIGN PATENT DOCUMENTS

| | | |
|---|---|---|
| CA | 2122797 A1 | 11/1995 |
| EP | 1584508 A1 | 10/2005 |

OTHER PUBLICATIONS

European Search Report, European Application No. 14153778.7-1602, Applicant: Petra Engineering Industries Co., dated Sep. 2, 2014, pp. 1-7.

(Continued)

*Primary Examiner* — Steven B McAllister
*Assistant Examiner* — Samantha Miller
(74) *Attorney, Agent, or Firm* — Cesari and McKenna, LLP; Michael R. Reinemann

(57) ABSTRACT

An exhaust air shutter assembly may include a housing having a dividing wall separating the exhaust air shutter assembly into an inside portion and an outside portion. An opening may be formed in the dividing wall and a frame may be mounted around the perimeter of the hole. Disposed on the frame may be a gasket that extends around the entire perimeter of the hole. The exhaust air shutter also may include at least one shutter flap mounted adjacent to the frame with a hinge such that the shutter flap can pivot between a closed position and an open position. When the shutter flap is in the open position, an air flow path exists from the inside portion of the exhaust air shutter assembly to the outside portion. When the shutter flap is in the closed position the air flow path is blocked. The shutter flap is configured to contact the gasket mounted to the frame when the shutter flap is in the closed position, thereby creating a seal between the shutter flap and the opening in the dividing wall.

21 Claims, 7 Drawing Sheets

(56) References Cited

U.S. PATENT DOCUMENTS

| | | | | |
|---|---|---|---|---|
| 4,872,397 | A | 10/1989 | Demeter | |
| 5,232,402 | A * | 8/1993 | Lorenzon | 454/222 |
| 5,383,816 | A | 1/1995 | Marcello et al. | |
| 5,388,759 | A * | 2/1995 | Barnes | 232/35 |
| 6,341,581 | B1 * | 1/2002 | Gabriel et al. | 119/419 |
| 6,517,429 | B1 * | 2/2003 | O'Connell et al. | 454/56 |
| 6,660,227 | B2 * | 12/2003 | Lopez Ordaz | 422/24 |
| 6,960,244 | B2 * | 11/2005 | Lehman | 95/273 |
| 7,734,381 | B2 * | 6/2010 | Conger et al. | 700/301 |
| 8,968,061 | B2 * | 3/2015 | Chalou et al. | 454/61 |
| 2003/0070404 | A1 * | 4/2003 | Calabrese | 55/385.2 |
| 2003/0103881 | A1 * | 6/2003 | Lane et al. | 422/292 |
| 2005/0066908 | A1 * | 3/2005 | Park | 119/419 |
| 2007/0259616 | A1 * | 11/2007 | Scattolin et al. | 454/184 |
| 2008/0066688 | A1 * | 3/2008 | Malnati et al. | 119/419 |
| 2008/0233861 | A1 * | 9/2008 | Jenkins et al. | 454/241 |
| 2011/0097990 | A1 | 4/2011 | Charron | |
| 2012/0149294 | A1 | 6/2012 | Labrecque | |
| 2013/0005238 | A1 * | 1/2013 | Brandt | 454/275 |
| 2013/0012118 | A1 * | 1/2013 | Garner et al. | 454/338 |
| 2013/0118083 | A1 * | 5/2013 | Khoshkish | 49/171 |

OTHER PUBLICATIONS

"Backdraft & Pressure Relief Dampers," Greenheck Fan Corporation, Dec. 2010, pp. 1-12.

"CBD2 Counterbalanced Backdraft Damper," Ruskin, 2008, pp. 1-2.

"CBD6 Counterbalanced Backdraft Damper," Ruskin, 2005, pp. 1-2.

"Extruded Backdraft Damper: Adjustable Counterbalance, EMV-11" Greenheck Fan Corporation, Apr. 1, 2009, pp. 1-2.

Industrial Backdraft Damper, Model HB-120, Greenheck Fan Corporation, Dec. 8, 2011, pp. 1-3.

"Installation Instructions: Backdraft Dampers," Ruskin, 2010, pp. 1-2.

Knapp, John, "Damper Leakage Rates—More Important Than Ever," AMCA International InMotion, Fall 2007, pp. 1-4.

"S3G Backdraft Damper," Ruskin Manufacturing, 1997, pp. 1-2.

* cited by examiner

GRAVITY SHUTTER

BACKGROUND OF THE INVENTION

Field of the Invention

The present invention relates to air handling systems, such as heating and cooling systems and, more particularly, to a gravity exhaust air shutter.

Background Information

Many commercial buildings are heated and/or cooled by one or more self-contained, packaged air-conditioning units. Many of these units are installed on the roof tops of such buildings. These units typically include cooling equipment, air handling fans, and may further include dehumidifiers and heating equipment. The units receive return air from the building, cool (or heat) the received return air, and supply the cooled (or heated) return air back to the building. Some units also include exhaust fans for discharging some portion of the return air from the building. The exhaust fans are typically mounted next to an exhaust opening of the unit. In a prior design, a series of is louvered slats are disposed at the opening. The louvered slats may extend the width of the opening, and may overlap each other when in the lowered, e.g., closed, position. Pins on the ends of the louvered slats may be mounted in holes formed in the sides of the exhaust opening, thereby allowing the louvered slats to swing open when the exhaust fans are turned on.

Outside air often leaks into the unit through these louvered slats. The occurrence of outside air leaking into the unit can degrade its performance. Accordingly, a need exists to improve the performance of packaged units and other air handling systems.

SUMMARY OF THE INVENTION

Briefly, the invention relates to a gravity exhaust air shutter assembly for use in heating, ventilation and air conditioning (HVAC) systems, such as a packaged air conditioning unit, an air handling unit, and a ventilation unit, among others. A packaged air conditioning unit, which may be mounted on the roof top of a building to be cooled, may include a plurality of components. In particular, the packaged unit may include an economizer designed to mix return air from the building with outside air, and deliver it to one or more air treatment components, such as cooling units, heating units, dehumidifying units, filter units, etc. The air mixture is treated and supplied to the building by one or more supply air blowers. The air conditioning unit may also include a return air unit that includes an inlet for receiving return air from the building, an outlet for delivering at least a portion of the return air to the economizer, and an exhaust unit for discharging at least a portion of the return air to the outside. The exhaust unit may include one or more exhaust fans, and one or more of the gravity exhaust air shutter assemblies of the present invention. The exhaust unit may be configured to reduce or prevent back draft of outside air into the economizer.

The exhaust air shutter assembly may include at least one shutter flap mounted adjacent to an open frame with a hinge, such that the shutter flap pivots between a closed position and an open position. When the shutter flap is in the open position, an air flow path exists from the return air inlet, through the one or more exhaust fans, and through the open frame to the outside. When the shutter flap is in the closed position, this air flow path is blocked, preventing return air from being discharged to the outside. The shutter flap and the open frame may each be generally rectangular shaped with the shutter flap sized slightly larger than the frame, although other shapes may be used. The open frame may be positioned at an angle to the horizontal, and the shutter flap, when in the closed position, may sit on top of, and thus close off, the open frame to the outside. Mounted around the perimeter of the frame on the side adjacent to the shutter flap is a gasket. The gasket may be a closed cell material. The shutter flap contacts the gasket when the shutter flap is in the closed position thereby creating a seal between the shutter flap and the open frame.

The one or more exhaust fans may be operated by a controller of the packaged unit. When the controller determines that some portion of return air should be discharged to the outside, the controller activates the one or more exhaust fans. Operation of the one or more exhaust fans creates a positive air pressure after the fans that lifts the shutter flap from the closed to the open position. While the shutter flap is in the open position, a portion of the return air is discharged from the packaged unit through the open frame. The remaining return air, i.e., that portion of the return air that is not discharged outside, flows into the economizer and may be mixed with outside air before being cooled and delivered into the building.

When the controller determines that no portion of return air needs to be discharged from the packaged unit, it turns the one or more exhaust fans off. With the one or more exhaust fans turned off, gravity forces the hinged shutter flap to the closed position where the shutter flap sits on the open frame. Due to the seal formed between the shutter flap and the gasket, return air is prevented from leaking out of the return air unit, and outside air does not enter the return air unit. In addition, with the one or more exhaust fans turned off, a negative air pressure may be created in the return air unit and the economizer by operation of the supply air blower. The shutter flap is configured so that this negative air pressure draws the shutter flap against the gasket, thereby further reducing any return air leakage, and any outside air entering the return air unit. Furthermore, the higher the negative pressure, the better the seal that is formed, as the shutter flap continues to be drawn against the gasket. The configuration of the exhaust air shutter assembly results in a zero leakage gravity shutter.

In an embodiment, the return air unit may include a plurality of exhaust air shutter assemblies.

In another embodiment, the exhaust air shutter assembly may be utilized as a pressure relief shutter. In particular, one or more weights may be affixed to the shutter blade. The one or more weights may be configured to hold the shutter blade in the closed position until a determined pressure level is generated on the inside portion of the exhaust air shutter assembly relative to the outside. When the pressure differential between the inside and outside portions reaches the predetermined level, the weighted shutter blade is lifted off of the of the open frame, and air from the inside portion may be released.

BRIEF DESCRIPTION OF THE DRAWINGS

The description below refers to the accompanying drawings, of which.

DETAILED DESCRIPTIONS OF ILLUSTRATIVE EMBODIMENTS

Figure 1:
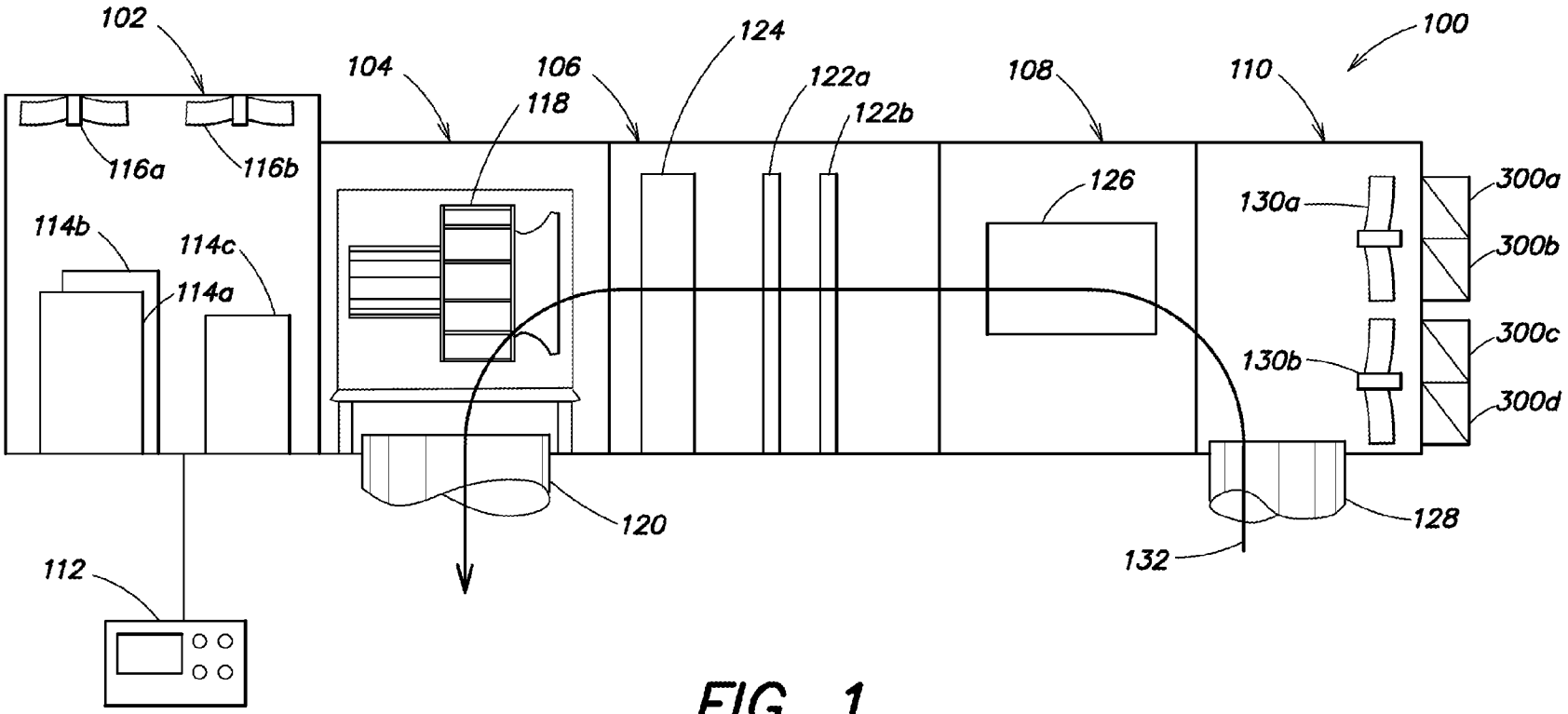
FIG. 1 is a schematic side elevation view of a packaged air conditioning unit in accordance with an embodiment of the present invention.
Figure 2:
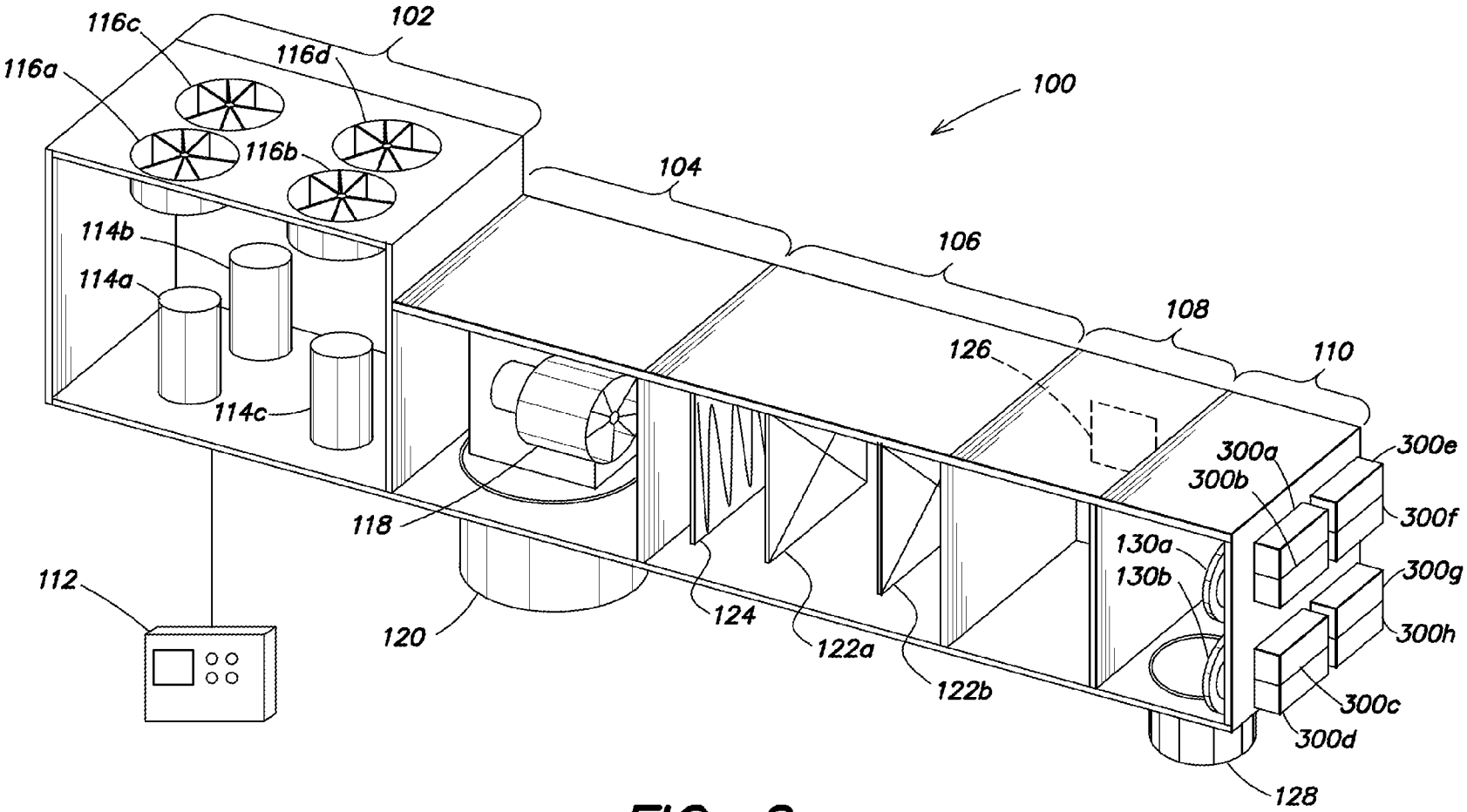
FIG. 2 is a schematic, cut-away perspective view of the packaged air conditioning unit of FIG. 1.

FIG. 1 is a schematic side elevation view of a packaged air conditioning unit 100, which may be mounted on the roof top of a building being cooled and/or heated. FIG. 2 is a schematic, cut-away perspective view of the unit 100. The packaged air conditioning unit 100 may include a plurality of components. In particular, it may include a condenser section 102, a supply air section 104, an air treatment section 106, an economizer 108, an air discharge section 110, and a controller 112. The condenser section 102 may include one or more compressors, such as compressors 114*a-c*, and one or more condenser fans, such as condenser fans 116*a-d*. The supply air section 104 may include at least one supply air blower, such as blower 118, adjacent to a supply air duct 120. The air treatment section 106 may include one or more air treatment elements. For example, the air treatment section 106 may include one or more filters, such as filter assemblies 122*a-b*, and one or more cooling coils, such as cooling coil 124. The air treatment section 106 may include other elements, such as one or more heating units, one or more dehumidifiers, etc. (not shown).

The economizer 108 may include one or more air intake vents, such as vent 126. The air discharge section 110 may include a return air duct 128, one or more exhaust fans, such as fans 130*a-b*, and one or more gravity shutter assemblies 300*a-h*. The exhaust fans 130*a-b* and gravity shutter assemblies 300*a-b* may be mounted on opposite sides of exhaust air vents in the air discharge section 110. In particular, the gravity shutter assemblies 300*a-h* may be disposed on a downstream side of the exhaust air vents relative to the exhaust fans 130*a-b*. In the illustrated embodiment, the unit 100 includes four exhaust fans 130, and two exhaust air shutter assemblies 300 are provided adjacent to each exhaust fan 130. The exhaust fans 130*a-b* of the air discharge section 110 may be axial fans, and may be mounted and configured to force a portion of return air horizontally from the air discharge section 110 through the exhaust air vents and the exhaust air shutter assemblies 300 to the outside. Each exhaust shutter assembly 300 may include at least one shutter blade as described further herein.

One or more hoods and screens (not shown) may be placed over the air intake vent 126 of the economizer 108 to prevent rain, debris, birds or other objects from entering the unit 100. The economizer 108 also may include a plurality of moveable dampers adjacent to the air intake vent 126 for controlling the amount of outside air that is mixed with the return air received from the air discharge section 110. A plurality of dampers may also be disposed adjacent to the exhaust air vents of the air discharge section 110 to control the amount of return air that is discharged outside.

In operation, the compressors 114*a-c* of the packaged air conditioning unit 100 receive a refrigerant in a vapor state, compress the refrigerant to a liquid state, and provide liquid refrigerant to the cooling coil 124. Activation of the supply air blower 118 creates a negative air pressure in the air discharge section 110, the economizer 108 and the air treatment section 106 relative to the outside air and the air in the building. As a result, return air is drawn from the building, through the return air duct 128 into the air discharge section 110. The received return air is then drawn into the economizer 108 where it may be mixed with outside air entering the economizer 108 through the air intake vent 126. In addition, a portion of return air may be discharged from the air discharge section 110 through the gravity shutter assemblies 300, as described further herein From the economizer 108, the mixed air is drawn through the air treatment section 106, and into the supply air section 104. As the air mixture is drawn through the air treatment section 106, it is filtered and cooled (or heated). It may also be dehumidified. The supply air blower 118 also forces the treated air into the supply air duct 120 from which it may be distributed within the building. Operation of the packaged air conditioning unit 100 is under the control of the controller 112. Arrow 132 (FIG. 1) shows the general flow of air through the unit 100.

It should be understood that FIGS. 1 and 2 represent a highly schematized view of a roof top packaged air conditioning unit 100, and that the unit 100 may include other or different sections, components or elements. Suitable packaged units for use with the present invention include the model PPH 35 from Petra Engineering Industries Co. of Amman Jordan.

Nonetheless, the present invention may be used with other packaged units, and with other HVAC systems or components. For example, it may be used with an air handling unit, a ventilation unit, or any other ventilation system that needs to exhaust air from a given space.

Figure 3:
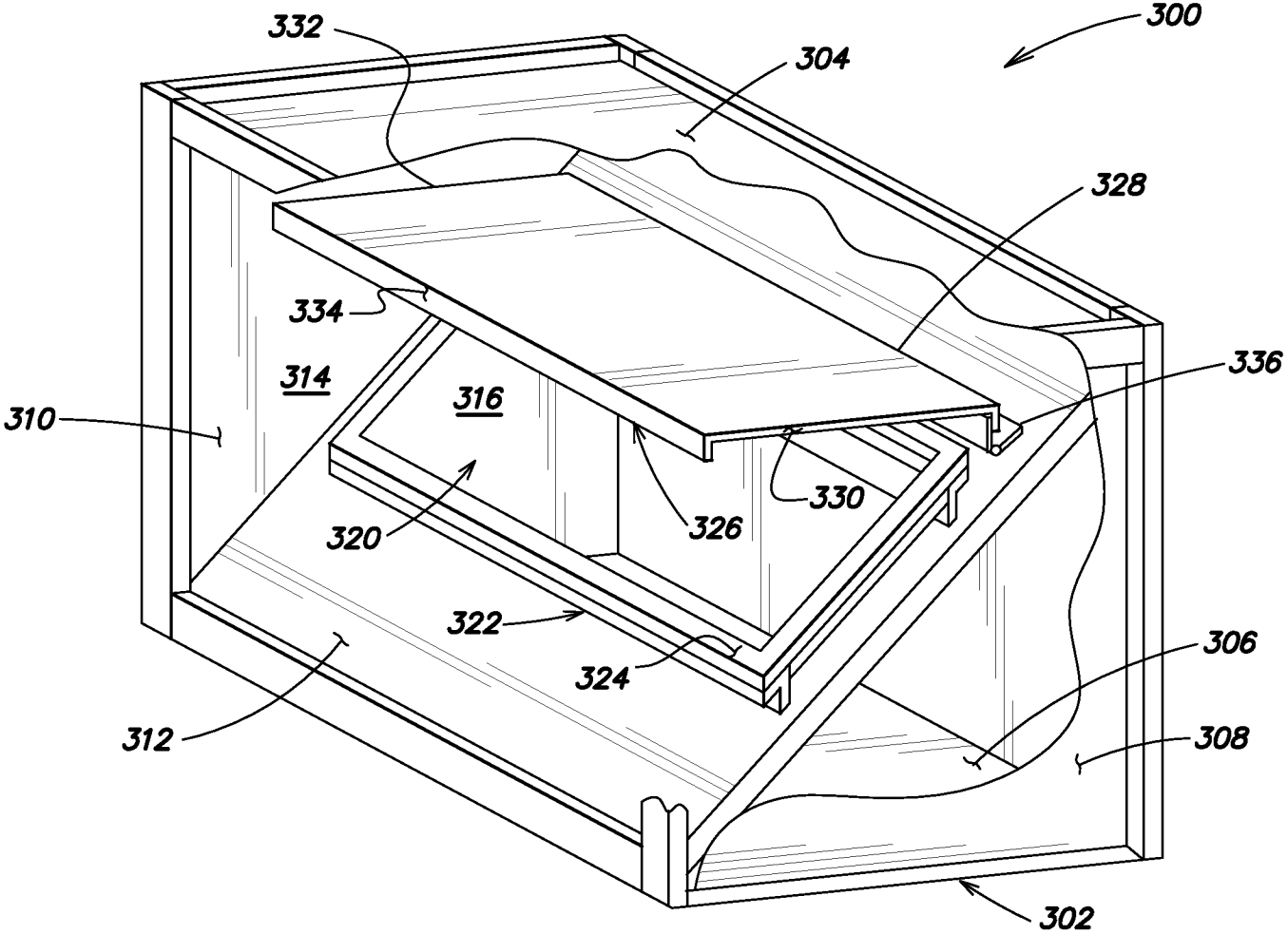
FIG. 3 is a schematic, cut-away perspective view of a gravity shutter assembly in accordance with an embodiment of the present invention.

FIG. 3 is a schematic, cut-away perspective view of a gravity shutter assembly 300. In an embodiment, the gravity shutter assembly 300 may include a housing 302 having a top panel 304, a bottom panel 306, and first and second side panels 308, 310. The panels 304-310 define an open interior space of the gravity shutter assembly 300. At least one dividing wall 312 may be disposed inside the interior space of the gravity shutter assembly 300. The at least one dividing wall 312 may extend vertically from the bottom panel 306 to the top panel 304, and horizontally from the first side panel 308 to the second side panel 310. The at least one dividing wall 312 may thus separate the gravity shutter assembly 300 into an outside portion 314 and an inside portion 316 where the outside portion 314 is open to the outside, and the inside portion 316 is open to the inside of the unit 100. In particular, the at least one dividing wall 312 seals inside of the unit 100 from the outside.

An opening 320 may be formed in the at least one dividing wall 312. For example, a generally rectangular opening 320 may be formed in the at least one dividing wall 312. Disposed around a perimeter of the opening 320 may be a frame 322. The dividing wall 312 may be planar, and the frame 322 may be raised relative to the plane of the dividing wall 312. The raised frame 322 may extend around the entire perimeter of the opening 320 in the dividing wall 312. The raised frame 322 may include a support surface that extends around the entire frame 322. A gasket 324 may be mounted to the support surface of the frame 322. The gasket 324 may extend around the entire frame 322. That is, to the extent the frame 322 is rectangular, the gasket 324 may extend around the top edge, the two side edges and the bottom edge of the raised frame 322.

The support surface of the frame 322 may define an elongated flat surface or strip, and the gasket 324 may be in the form of a narrow strip of material sized to cover substantially all of the support surface of the raised frame 322.

A moveable shutter blade 326 may be mounted over the opening 320 in the dividing wall 312. The shutter blade 326 may be planar, and may be shaped like the opening 320 and the raised frame 322. That is, to the extent the frame 322 is rectangular, the shutter blade 326 also may be rectangular in shape, and may have a top edge 328, first and second side edges 330, 332 and a bottom edge 334. The shutter blade 326 may be at least slightly oversized relative to the raised frame 322 to cover the entire frame 322 and thus the opening 320 in the dividing wall 312. At least one hinge 336 may be mounted to the shutter blade 326 so that the shutter blade 326 is moveable between an open position and a closed position. In particular, the at least one hinge 336 may be mounted to the top edge 328 of the shutter blade 326 and adjacent to the top edge of the raised frame 322.

Figure 4:
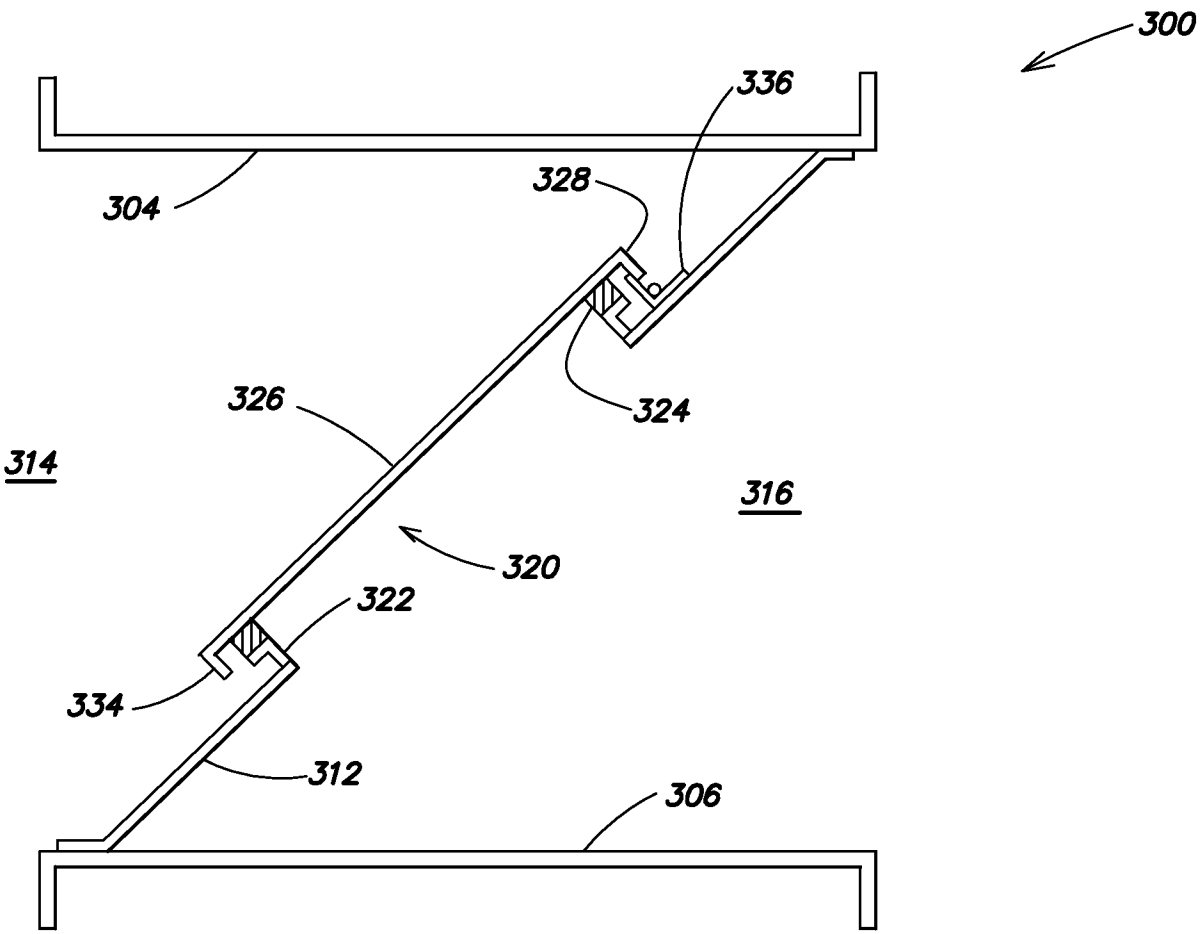
FIG. 4 is a schematic side elevation view of a gravity shutter assembly in a closed position in accordance with an embodiment of the present invention.
Figure 5:
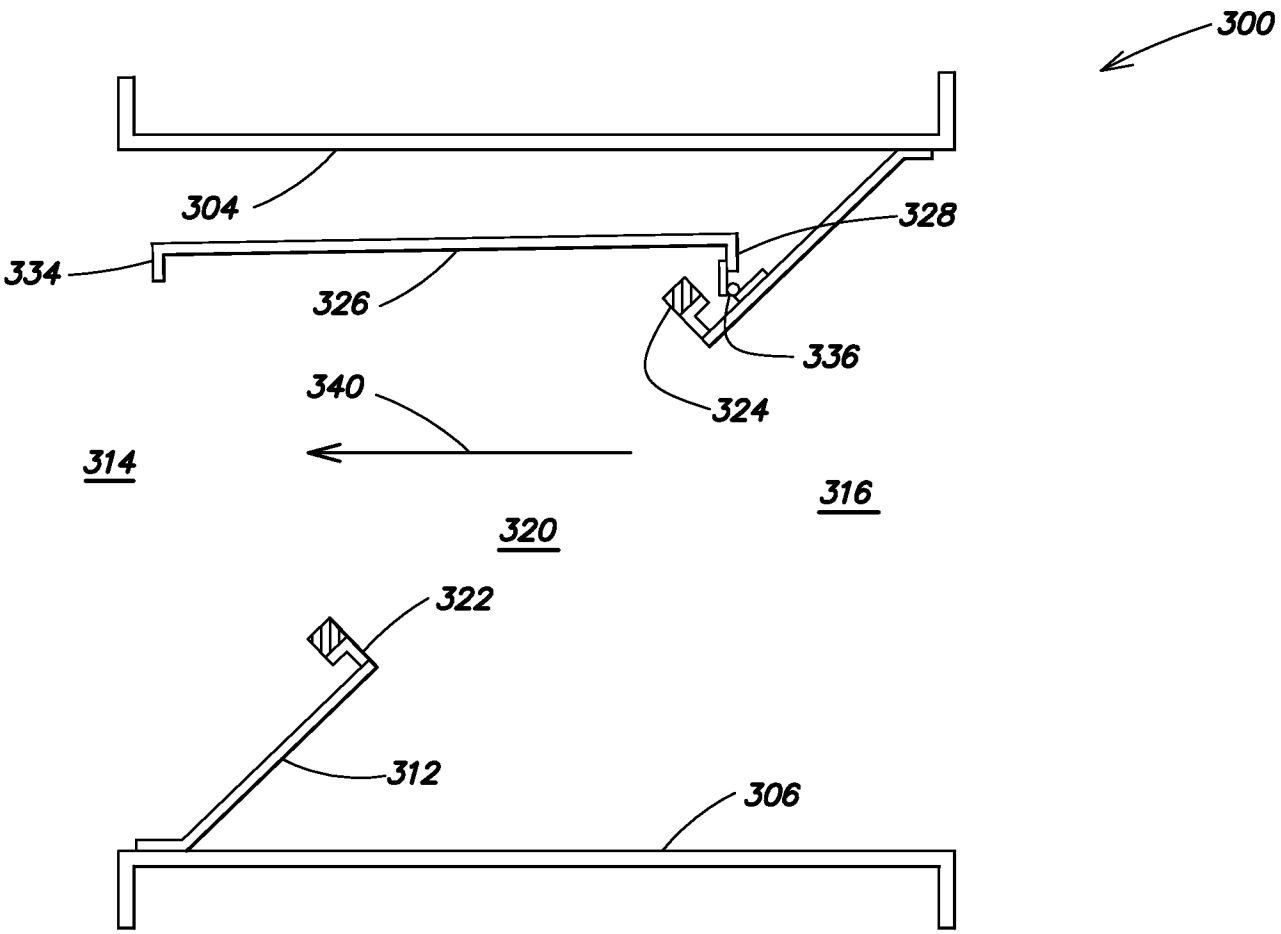
FIG. 5 is a schematic side elevation view of a gravity shutter assembly in an open position in accordance with an embodiment of the present invention.

FIGS. 4 and 5 are partial side elevation views of the gravity shutter assembly 300 of FIG. 3. FIG. 4 shows the shutter blade 326 in the closed position, and FIG. 5 shows the shutter blade 326 in the open position. Rather than being vertically mounted, the dividing wall 312 may be disposed at an angle within the gravity shutter assembly 300 relative to the vertical (or to the horizontal). An exemplary angle is 45 degrees, although other angles, such as angles between 30 and 70 degrees may be used. Nonetheless, other angles may also be used. As shown, the shutter blade 326 pivots about the hinge 336 between a closed position (FIG. 4) and an open position (FIG. 5). In the closed position, a portion of the planar surface of the shutter blade 326 contacts the gasket 324. In the closed position, the shutter blade 326 together with the dividing wall 312 seal the inside portion 316 of the gravity shutter assembly 300 from the outside portion 314. In the open position (FIG. 5) the shutter blade 326 is lifted off of the raised frame 322 and the dividing wall 312, thereby providing an air flow path from the inside portion 316 to the outside portion 314 through the opening 320 in the dividing wall 312, as illustrated by arrow 340.

The frame 322 may be formed from sheet metal. Specifically, the frame 322 may be formed as a U-shaped channel having two bends thereby defining a first side, a bottom and a second side. The first side of the frame may be joined to the at least one dividing wall 312, e.g., by rivets, welding, adhesives, or any combination thereof. The bottom side may define the opening 320. The second side may define the support surface to which the gasket 324 is mounted. The shutter blade 326 also may be formed from sheet metal. For example, the shutter blade 326 may be substantially planar with downturned edges to provide structural integrity to the shutter blade 326. Such a shutter blade 326 may generally have an inverted drip pan or cookie sheet shape.

The gasket 324 may be a closed cell foam material, such as closed cell polyvinyl chloride foam. Nonetheless, it will be understood that the gasket 324 may be formed from other materials, such as polyethylene foam, or from a combination of materials.

The gasket may be made an elastic material, and thus allow a seal to be formed despite irregularities and/or imperfections in the surface of the shutter blade and/or the frame, e.g., due to manufacturing, deformation or wear during operation, etc.

While a rectangular opening 320, frame 322 and shutter blade 326 have been shown, it should be understood that other shapes may be used. For example, circular, oval, triangular or other shapes may be used in the gravity shutter assembly 300.

Other modifications may also be made to the gravity shutter assembly 300. For example, the hinge 336 may be mounted to the top panel 304 of the housing 302, rather than to the dividing wall 312. In addition, rather than a hinge, one or more pivot pins may be used to attach the shutter blade 326 to, e.g., the first and second side panels 308, 310 of the housing 302. Other modifications are also possible. For example, the frame 322 may be omitted, and the gasket 324 may be disposed around the opening 320 in the dividing wall 312. In another embodiment, multiple frames 322 and shutter blades 326 may be disposed in the housing 302. In yet another embodiment, the gasket may be omitted and the shutter blade may be configured to close against the frame and/or the dividing wall to create a seal. That is, the surface of the shutter blade may be configured to conform to the surface of the frame and/or dividing wall to create a seal when the shutter blade is in the closed position.

During operation of the unit 100, the controller 112 may determine that some portion of the return air entering the air discharge section 110 should be discharged from the unit 100. In this case, the controller 112 may active one or more of the exhaust fans 130. Operation of the exhaust fans 130 generates a positive air pressure on the inside portion 316 of the gravity shutter assembly 300 relative to the outside portion 314. This positive air pressure overcomes the force of gravity holding the shutter blade 326 down against the gasket 324 and the frame 322, and lifts the shutter blade 326 off of the gasket 324 and the frame 322 into the open position (FIG. 5). With the shutter blade 326 in the open position, at least a portion of return air entering the air discharge section 110 is discharged to the outside. During operation of the exhaust fans 130, a negative pressure may still exist in the economizer 108 and in the air discharge section 110, for example, due to the operation of the supply air blower 118.

When the controller 112 determines that no portion of return air entering the air discharge section 110 needs to be discharged, it deactivates the exhaust fans 130. With the exhaust fans 130 turned off, the positive pressure in the inside portion 316 is no longer maintained. Gravity, acting on the shutter blade 326, forces the shutter blade 326 to pivot downwardly about the hinge 336 onto the gasket 324 and the frame 322. As noted, a portion of the planar surface of the shutter blade 326 contacts the gasket 324 mounted to the frame 322. With the shutter blade 326 in the closed position, the inside portion 316 is once again sealed from the outside portion 314, and outside air is blocked from entering the unit 100 through the gravity shutter assemblies 300 and the exhaust air vents in the air discharge section 110.

It should be understood that the hinge 336 may be placed at a location that is spaced from a center of mass of the shutter blade 326. In this way, gravity, acting on the shutter blade 326 through its center of mass causes the shutter blade 326 to pivot about the hinge 336.

Operation of the supply air blower of the unit 100 may create a negative air pressure in the air discharge section 110 and the economizer 108 relative to the outside air and the air in the building. This negative air pressure draws return air from the building into the air discharge section 110 through the return air vent 128. The negative air pressure also draws outside air into the economizer 108 where it is mixed with return air. The negative air pressure on the inside 316 of the gravity shutter assembly 300 (relative to the outside 314) also causes the shutter blade 326 to be pulled tighter against the gasket 324, thereby forming a tighter seal between the shutter blade 326 and the gasket 324. This tighter seal results in the gravity shutter assembly 300 being a zero leakage gravity shutter. Indeed, as the negative air pressure increases, the shutter blade assembly is configured to create an even tighter seal, making the shutter blade assembly especially suited to high negative pressure applications.

Figure 7:
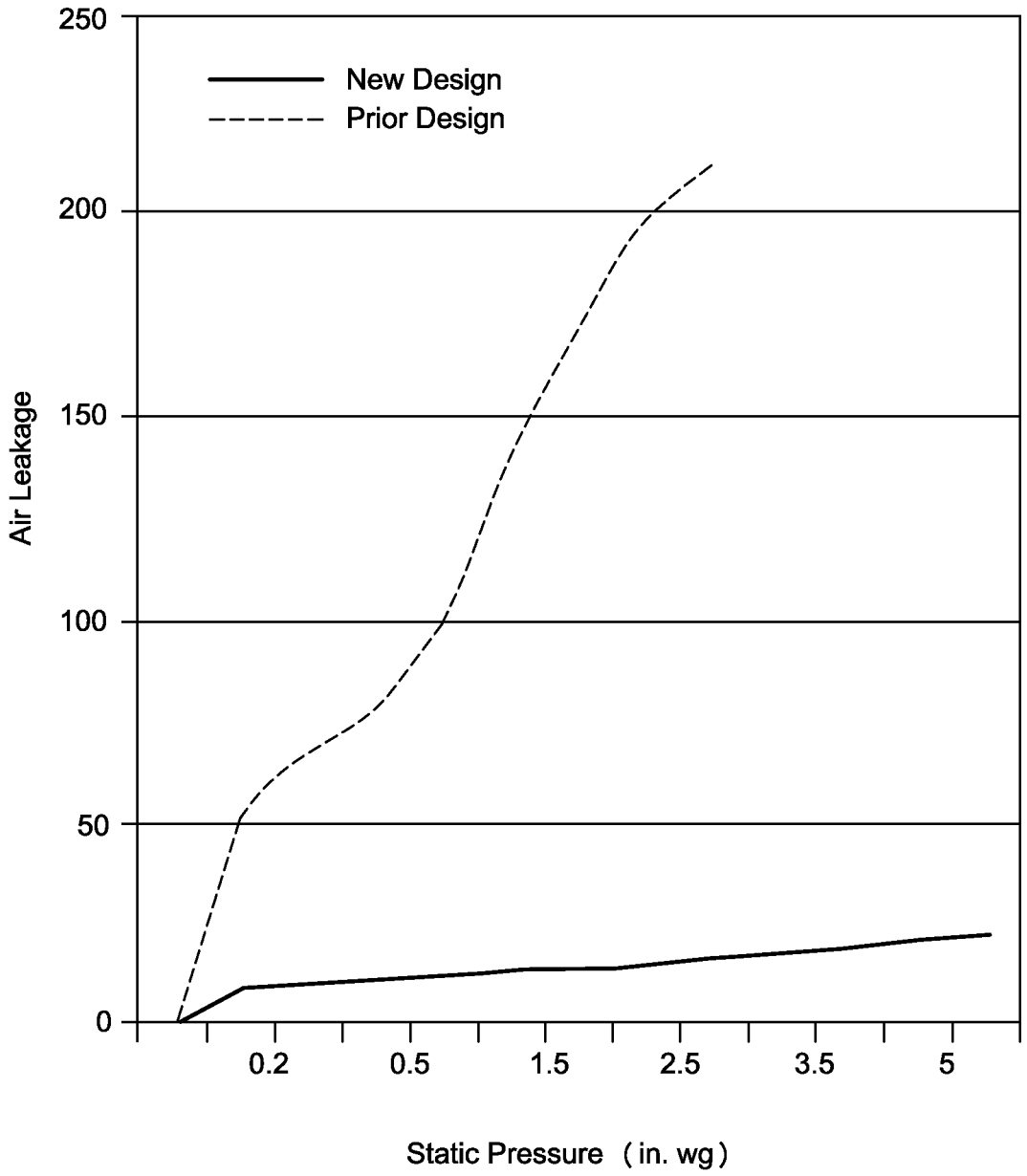
FIG. 7 is a plot of the test results of an embodiment of the present invention.

Testing of an embodiment of the gravity shutter assembly 300, and an earlier louvered slat design demonstrates the dramatically improved results. More specifically, positive air pressure was induced at the inside 316 of the gravity shutter assembly 300 and the earlier louvered slat design relative to the outside 314. This positive air pressure was varied, and the volume of air leaking through the gravity shutter assembly 300 and the prior design was measured. Below is a table setting forth the test results. FIG. 7 is a plot of the test results.

| Static Pressure (in. wg) | New design Air Leakage (cfm) | Prior Design Air Leakage (cfm) |
|---|---|---|
| 0.1 | 8.6 | 53.4 |
| 0.2 | 9.9 | 67.4 |
| 0.3 | 10.7 | 77.2 |
| 0.5 | 11.8 | 99 |
| 1 | 12.5 | 141.4 |
| 1.5 | 13.1 | 172.1 |
| 20 | 14 | 199.7 |
| 2.5 | 15.4 | 212 |
| 3 | 16.4 | |
| 3.5 | 17.6 | |
| 4 | 20.2 | |
| 5 | 20.8 | |

In FIG. 7, the static pressure is given in inches of water gauge (in. wg), which is a pressure differential measured between the inside portion 316 and the outside portion 314 of the gravity shutter assembly 300. The air leakage is given in cubic feet per minute (cfm).

Figure 6:
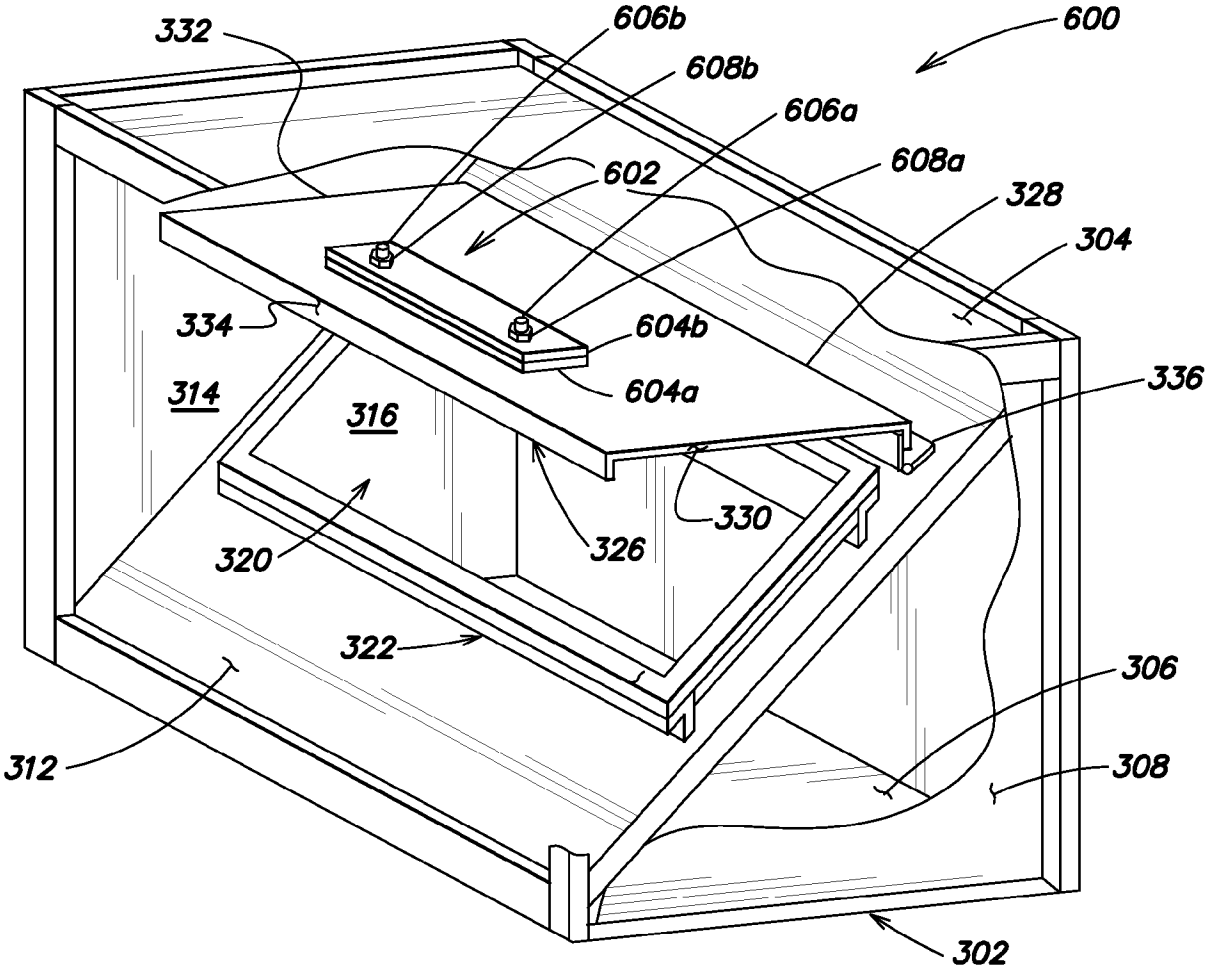
FIG. 6 is a schematic, cut-away perspective view of a gravity shutter assembly in accordance with another embodiment of the present invention.

FIG. 6 is a schematic, cut-away perspective view of a shutter assembly 600 in accordance with another embodiment of the present invention. The gravity shutter assembly 600 is similar to the shutter assembly of FIG. 3. However, the shutter assembly 600 further includes at least one weight assembly, such as weight assembly 602, mounted to the shutter blade 326. The weight assembly 602 may be mounted toward the bottom edge 334 of the shutter blade 326. That is, the weight assembly 602 may be mounted at a location that is offset from a center of mass of the shutter blade 326, and opposite to the pivot point defined by the hinge 326 relative to the center of mass. The weight assembly 602 may consist of one or more weight elements, such as weight elements 604*a-b*, which may be strips of a selected material, e.g., metal, and size, and thus weight. The weight assembly 602 may be attached to the shutter blade 326 by a plurality of thread studs 606*a-b* and nuts 608*a-b* where the thread studs 606*a-b* are welded to the shutter blade 326. Nonetheless, other securing techniques may be used, such as welding, nuts and bolts, adhesives, etc.

In this embodiment, the gravity shutter assembly 600 may be used as a pressure relief shutter. More specifically, if the pressure on the inside 316 of the shutter assembly 600 builds up and reaches a predetermined value, the pressure causes the shutter blade 326 to move to an open position, thereby releasing air and reducing the pressure on the inside 316 of the shutter assembly 600.

By adjusting the weight of the weight assembly 602, e.g., by adding or removing one or more weight elements 604, a user can configure or "tune" the shutter assembly 600 to open at a determined static pressure relative to the outside. For example, by adding one or more weight elements 604, the shutter assembly 600 may be configured to delay opening until a higher static pressure is reached. By removing one or more weight elements 604, the shutter assembly 600 may be configured to open earlier when a lower static pressure is reached.

It should be understood that those skilled in the art may make modifications or changes without departing from the scope or intent of the invention. For example, the housing may be eliminated, and the shutter blade may be mounted over the exhaust air vents in the air discharge section 110 of the packaged air conditioning unit 100 or other air handling system or device.

The foregoing description has been directed to specific embodiments of the present invention. It will be apparent, however, that other variations and modifications may be made to the described embodiments, with the attainment of some or all of their advantages. For example, the gravity shutter assembly may be used in an air handling system, such as an air conditioner, mounted on the roof top of a vehicle, such as a motor home. Therefore, it is the object of the appended claims to cover all such variations and modifications as come within the true spirit and scope of the invention.

What is claimed is:

1. An apparatus comprising:

a housing;

a dividing wall disposed in the housing to separate the housing into an inside portion and an outside portion;

an opening formed in the dividing wall, the opening defining a perimeter;

a gasket mounted around the perimeter of the opening formed in the dividing wall;

a shutter flap pivotally mounted adjacent to the opening, the shutter flap configured to pivot between a closed position in which the shutter flap rests on the gasket and blocks air from flowing from the inside portion of the housing to the outside portion of the housing, and an open position in which the shutter flap is lifted away from the opening in the dividing wall permitting air to flow from the inside portion of the housing to the outside portion of the housing through the opening.

2. The apparatus of claim 1 further comprising:

a frame mounted around the perimeter of the opening formed in the dividing wall, wherein the gasket is mounted to the frame.

3. The apparatus of claim 1 wherein the shutter flap is pivotally mounted to the dividing wall.

4. The apparatus of claim 1 wherein the shutter flap is pivotally mounted through one or more hinges.

5. The apparatus of claim 1 wherein the gasket is mounted around the full perimeter of the opening.

6. The apparatus of claim 1 wherein the gasket is formed from:

a closed cell foam material, an open cell foam material, or a combination of closed and open cell foam materials.

7. The apparatus of claim 1 wherein the opening and the shutter flap are rectangular.

8. The gravity shutter assembly of claim 7 wherein the gasket extends completely around the frame perimeter.

9. The apparatus of claim 1 wherein
the dividing wall is disposed at an angle relative to a horizontal reference.

10. The apparatus of claim 9 wherein
the opening has a top edge, and
a hinge is disposed along the top edge of the opening.

11. The apparatus of claim 9 wherein the angle is approximately 45 degrees.

12. The apparatus of claim 1 further comprising:
one or more weights attached to the shutter flap.

13. A gravity shutter assembly comprising:
an open frame defining a frame perimeter;
a gasket disposed around at least a portion of the frame perimeter; and
a shutter flap pivotally mounted adjacent to the open frame, the shutter flap configured to pivot between
a closed position in which the shutter flap rests on the gasket and blocks air from flowing through the open frame, and
an open position in which the shutter flap is lifted away from the open frame permitting air to flow through the open frame,
wherein the gasket is formed from
a closed cell foam material,
an open cell foam material, or
a combination of closed and open cell foam materials.

14. The gravity shutter assembly of claim 13 wherein
the open frame is rectangular shaped,
the shutter flap is rectangular shaped, and
the shutter flap is larger than the open frame.

15. The gravity shutter assembly of claim 13 further comprising:
at least one exhaust air fan mounted adjacent to the open frame opposite the shutter flap.

16. The gravity shutter assembly of claim 15 wherein
operation of the at least one exhaust air fan moves the shutter flap from the closed position to the open position.

17. The gravity shutter assembly of claim 13 further comprising:
a hinge attached to the shutter flap and the open frame.

18. The gravity shutter assembly of claim 17 wherein
the open frame is disposed at an angle relative to a horizontal reference,
the open frame has a top edge, and
the hinge is disposed along the top edge of the open frame.

19. The gravity shutter assembly of claim 18 wherein the angle is approximately 45 degrees.

20. A packaged air conditioning unit comprising:
a return air section configured to receive return air from a space;
an economizer coupled to the return air section, the economizer configured to mix outside air with the received return air;
an air treatment section coupled to the economizer, the air treatment section configured to treat a mixture of the outside air and the received return air; and
a supply air section coupled to the air treatment section, the supply air section configured to provide a treated mixture of the outside air and the received return air to the space, wherein the return air section includes:
at least one exhaust fan,
at least one exhaust vent, and
at least one gravity shutter assembly mounted adjacent to the at least one exhaust vent, the at least one gravity shutter assembly including:
an open frame defining a frame perimeter, the open frame adjacent to the at least one exhaust vent;
a gasket disposed around at least a portion of the frame perimeter;
a shutter flap pivotally mounted adjacent to the open frame, the shutter flap configured to pivot between
a closed position in which the shutter flap rests on the gasket and blocks the received return air from flowing from the return air section through the open frame, and
an open position in which the shutter flap is lifted away from the frame permitting at least a portion of the received return air to flow from the return air section through the open frame.

21. The packaged air conditioning unit of claim 20 wherein the shutter flap is configured to move
from the closed position to the open position due to operation of the at least one exhaust fan, and
from the open position to the closed position due to gravity.

* * * * *